United States Patent [19]

Ferrada et al.

[11] Patent Number: 4,736,894

[45] Date of Patent: Apr. 12, 1988

[54] GRINDING MILL LINING SYSTEM

[75] Inventors: Ricardo C. Ferrada; Hugo B. Migueles, both of Rancagua, Chile

[73] Assignee: Corporacion Nacional del Cobre de Chile, Santiago, Chile

[21] Appl. No.: 842,065

[22] Filed: Mar. 20, 1986

Related U.S. Application Data

[63] Continuation-in-part of Ser. No. 704,794, Feb. 25, 1985, abandoned.

[51] Int. Cl.[4] ..... B02C 17/22

[52] U.S. Cl. ..... 241/30; 29/526 R; 241/183; 241/300

[58] Field of Search ..... 241/182, 183, 299, 284, 241/300, 26, 30; 29/526 R

[56] References Cited

U.S. PATENT DOCUMENTS 2,801,804 8/1957 Frankert ..... 241/183
4,243,182 1/1981 Dugger Jr. ..... 241/183 X

FOREIGN PATENT DOCUMENTS 29030 1/1974 Chile .
29208 6/1974 Chile .
29519 9/1974 Chile .

*Primary Examiner*—Mark Rosenbaum
*Attorney, Agent, or Firm*—Pennie & Edmonds

[57] ABSTRACT

A cylindrical grinding mill liner comprising a continuous uninterrupted internal helical fluting extending along the length of the liner. A cylindrical grinding mill with an inner liner comprising a continuous uninterrupted internal helical fluting for the grinding or crushing of ore. A method for segregating or distributing ore particles and grinding bodies along a cylindrical grinding mill with the larger sizes at the feed end and the smaller sizes at the discharge end.

29 Claims, 5 Drawing Sheets

GRINDING MILL LINING SYSTEM

This is a continuation-in-part of application Ser. No. 704,794, filed Feb. 25, 1985, now abandoned.

TECHNICAL FIELD

The present invention relates generally to cylindrical grinding mills, and particularly to a method and apparatus for improved grinding and crushing of ore and improved segregation of the grinding media, as well as for protecting the shell of such grinding mills from abrasive wear.

BACKGROUND ART

When conventional linings are utilized for the protection of the shell of cylindrical grinding mills, the large grinding bodies tend to migrate or segregate to the discharge end of the mill, regardless of the portion of the mill in which they are loaded, while the smaller grinding bodies tend to accumulate at the ore feed end. This migration provides an unfavorable environment for efficient crushing or grinding of the ore due to the lack of large grinding bodies in the zone where the ore enters the mill. It is a further disadvantage with respect to the effective grinding area of the grinding bodies in the discharge zone since the presence of the larger bodies reduces the effective grinding area which is necessary for final finishing.

Thus, the efficiency of the grinding process can be improved if this segregation is reversed, since the breaking or crushing power of the larger bodies would be better employed against the larger ore particles introduced into the feed zone, while the friction provided by the smaller bodies would operate better on the smaller ore particles in the discharge end of the mill.

Various methods have been used to remedy this type of migration. The simplest procedure consists of increasing the thickness of the lining towards the discharge side of the mill by either gradually increasing the thickness of the lining or by using structural supports to increase the lining thickness. Truncated, cone-shaped mills have also been used. These make it possible to achieve a situation whereby the large grinding bodies remain in the loading or front sector of the mill, while the smaller bodies are properly distributed throughout the mill but primarily on the discharge side.

For dry grinding, such as that required by the cement industry, ball mills have been used with sections or compartments that are separated by a grating or grooved partition. These provide individual chambers within the mill to maintain a selective segregation or a desired distribution of the grinding bodies.

The design of the lining itself or of the shell protecting plates or shields which make up the lining can be altered to achieve the desired distribution of grinding bodies. For example, Chilean Pat. No. 29,208 entitled "Armor Plate Lining for Tube or Cylindrical Mills", discloses a lining formed by polygonal sections having rounded corners and rectilinear sides which are formed by shielding ring plates. These sections are oriented in such a manner that the rounded and straight edges of the plates are alternated. A structural supporting system, covered by Chilean Pat. No. 29,030 is used for the assembly of this lining.

By utilizing the above-described method, the distribution of the grinding bodies is achieved by means of a four-pitch screw effect imparted by the individual rings of the plates, because these rings are spaced apart from each other along the length of the mill. The assembly of this system, however, is quite complicated and difficult, and structural supports are required in order to obtain the shape of the polygonal cross section of the lining. Furthermore, since the lining does not form a continuous path along the mill, it does not fully achieve the desired size distribution of the grinding bodies throughout the mill.

Another method of distributing particles by size is found in Chilean Pat. No. 29,519, entitled "Improved System for Concentrating Ores by Means of a Spiral Chute". This patent discloses a vertical, descending spiral chute which separates ore particles of various specific gravities. This is not a rotary device, however, and it separates ore pulp by the movement of the particles. The ore flows through this device by gravity, and the centrifugal force imparted by the rotary path of the particles along the spiral configuration of the chute achieves the desired size distribution. This patent, however, does not disclose how to distribute grinding bodies in a horizontal ball mill.

The applicants have now discovered a novel and unobvious protective plate lining for the shells of cylindrical grinding mills wherein plates having a variable pitch ratio from helical flutings which make it possible to obtain a rapid and stationary distribution of the grinding bodies and ore load throughout the length of the mill. This distribution results because the lining imparts a helical forward motion to the grinding bodies and ore particles in a direct ratio to the mass or weight of these bodies and particles. This effect is the result of the combined action of the spacing of the helical flutings, gravity, the rotation of the mill, and the diametrical pitch of the lining.

This new lining does not require the use of additional supports or support elements between the shell and the plates, nor does it require the installation of gratings or partitions to produce separate grinding compartments. Thus, the new lining can be assembled in a much shorter time than conventional linings. Furthermore, the invention does not appreciably reduce the section or useful volume of the mill, and this allows for the processing of greater tonnages of ore than conventional-type ball mills of the same or similar size.

SUMMARY OF THE INVENTION

One embodiment of the invention relates to a helical fluted liner used for the protection of the shell of cylindrical grinding mills wherein the grinding bodies are properly distributed along the length of the mill for optimum grinding. This fluting can be inscribed onto a single liner or onto a predetermined number of plate members which are positioned and oriented such that the helical fluting of adjacent plate members forms a number of continuous uninterrupted helical paths along the entire length of the liner. The non-rectilinear fluting has a predetermined diametrial pitch ratio of from about 0.05 to 0.57 mill turns per length of the mill.

Alternative embodiments entail varying the width of the helical flutings or the thickness of the plate members. One variation of the invention consists of a fluted liner wherein the plate members increase in thickness along the length of the mill, from the loading zone to the discharge zone and are inclined with respect to the longitudinal axis of the liner. One further variable feature is the inclination of the plate members which comprise the helical fluting. The optimum inclination, with respect to the longitudinal axis of the liner, ranges between about 2 and 30 degrees.

The plate members which make up the inner liner do not require the use of an additional structural supporting system or weight-bearing element between the outer shell and the plates.

Another aspect of the invention relates to a method for segregation or distribution ore particles and grinding bodies in a cylindrical grinding mill. Once the ore and the grinding bodies are placed into the feed end of the mill, they become distributed through the action of the helical fluting of the inner lining such that the larger ore particles and grinding bodies remain near the feed end while the smaller ore particles and grinding bodies move toward the discharge end of the mill.

The direction and position of the helical fluting on the liner is determined as a function of the direction of rotation and the rotary speed of the mill. In alternative embodiments of the invention, the residence time of the ore particles in the mill may be varied by modifying the geometry of the helical fluting, as well as by altering the thickness and/or angle of inclination of the plate members.

BRIEF DESCRIPTION OF THE DRAWINGS

Further benefits and advantages of the invention will become apparent from a consideration of the following description given with reference to the accompanying drawing figures which specify and show preferred embodiments of the present invention, wherein.

DETAILED DESCRIPTION OF THE PREFERRED EMBODIMENTS

The invention relates to a protective plate lining for the shell of a cylindrical grinding mill which is used for grinding ore with spherical grinding bodies (i.e. balls) or other similar grinding means. These plates, which may be of variable thickness, are placed inside the cylindrical shell of the mill to provide a continuous, uninterrupted corrugated helical configuration in order to enable the grinding bodies and the ore particles to be ground so as to be adequately distributed by size from the feed end to the discharge end of the grinding mill.

The rapid and stationary distributing or segregating effect of the balls or grinding bodies is, in general, achieved by the inventive design which comprises a non-rectilinear corrugated circular lining with helical flutings having a diametral pitch ratio which is determined on the basis of the diameter of the mill and the requisite grinding parameters. This diametral pitch ratio has been determined by experimentation to be most efficient at between about 0.05 and 0.45 and preferably about 0.2 to 0.3 turns/length of the mill by industrial trials. Variations in the shape, width, size, distribution, depth and location of the helical fluting makes the claimed grinding process more efficient and economical.

Figure 1:
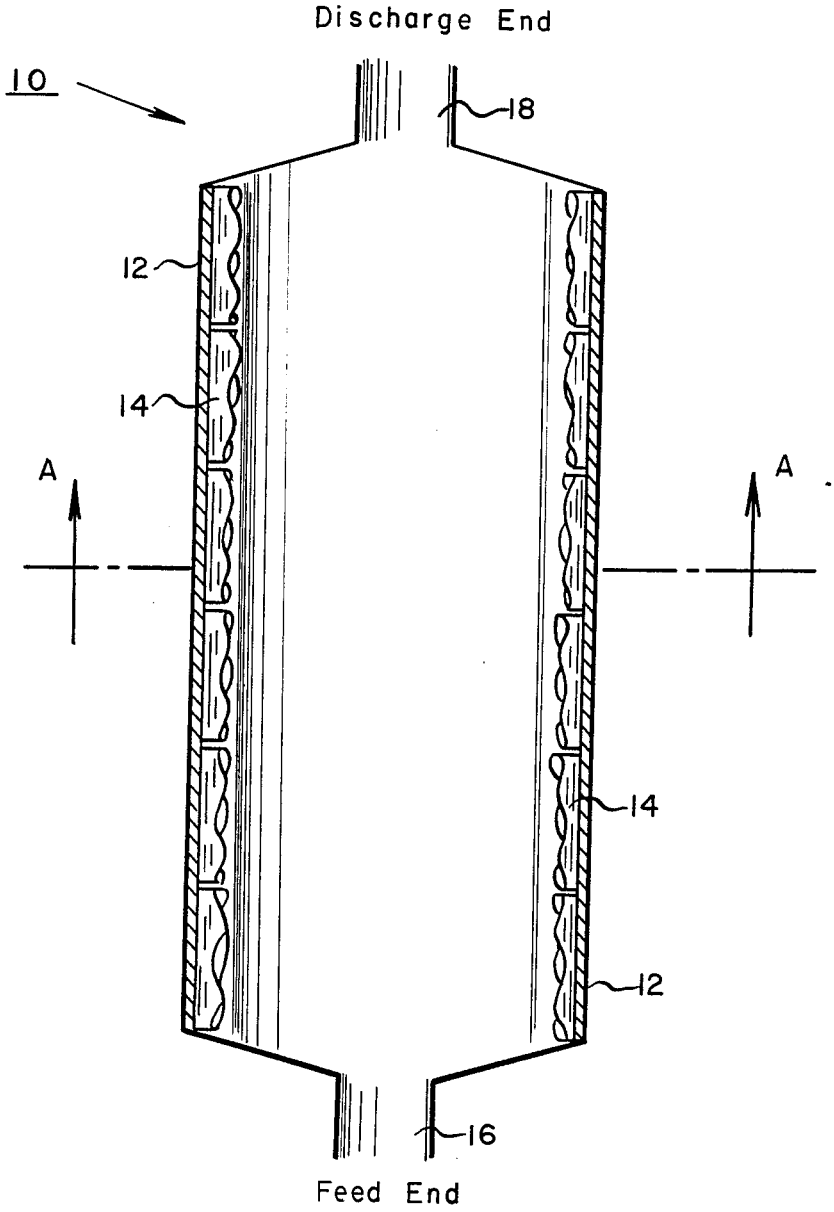
FIG. 1 is a longitudinal cross-section of the inner liner and shell of a cylindrical grinding mill according to the invention.

A typical ball grinding mill 10 is shown in FIG. 1. This grinding mill 10 is used to crush ore or rock containing metal or metals which may be profitably extracted. The mill 10 consists first of an outer shell of a supporting material 12, such as steel, cast iron, or the like. The inner lining 14, preferably comprised of a series of impact and abrasion resistant plates, is installed directly onto the outer shell. These plates then protect the outer shell from the impact and abrasion of the grinding bodies and serve to distribute these bodies and the ore along the mill from the feed end 16 to the discharge end 18.

Figure 2A:
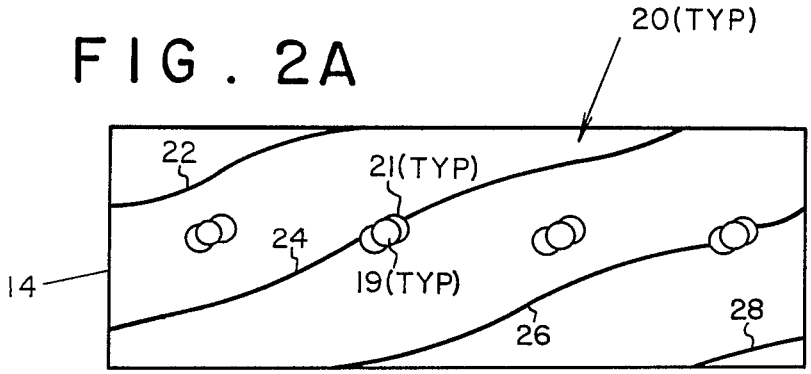
FIG. 2A is a top view of a typical liner showing two different inclination angles.

FIGS. 2A illustrates a typical configuration of the liner of the invention. This liner generally consists of plates 14 that are placed inside the cylindrical shell 12 of the mill 10, thus forming internal helical flutings which produce lengthwise helicoids having a corrugated cross-sectional configuration along the entire length of the mill.

As shown in FIG. 2A, the plates 14 of the liner can preferably be attached to the shell by bolts 19 which extend through the liner at slot 21. The number of slots 21 and bolts 19 used to secure the plates 14 of the lining would vary depending upon the size and shape of the plates 14. Also, other securing means can be used.

An alternate embodiment of the invention entails coating the interior portion of the outer shell of the grinding mill with a castable refractory or ceramic material and inscribing the helical flutings directly onto the coating itself. In this arrangement, the bolting means would not be necessary. However, an advantage of the use of plate members is that they may be readily removed by loosening the bolts 19 for repair or interchange with other plates of the same or a different configuration.

Figure 2B:
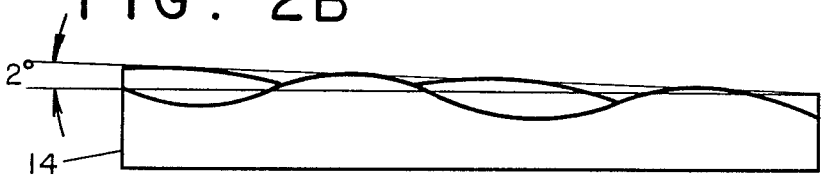
FIGS. 2B and 2C are side views of two different liners to illustrate different inclination angles according to the invention.
Figure 2C:
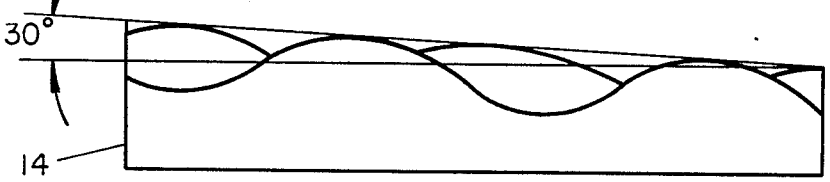

The gradual classification and distribution by size of the grinding bodies along the horizontal axis of the mill can be made even more effective by varying the angle of inclination possessed by the plates. To allow for optimal particle size movement and distribution, the inclination of the plates must be less than 90°. The most efficient and therefore, most desireable range of inclination has been found to be between 2° and 30°, according to the extent of grinding desired, as illustrated in FIGS. 2B and 2C. Furthermore, by varying this angle of inclination, the movement of the ore load through the mill can be accelerated or retarded, as desired, for the specific grinding requirements for each particular ore.

Various configurations of the shape, size, quantity, depth, distribution and location of the flutings in the lining may be used, depending upon the ratio of the mill (diameter/length) and the grinding conditions required in each case. For example, the liner can be inclined as described above or the liner plates can be of a uniform thickness. There are many other configurations which are effective for each particular grinding situation. By modifying the configuration of the helical fluting, the residence time of the ore particles can be correlated to the desired grinding requirements.

The fluting of the proposed lining, with its helical effect 20 as shown in FIG. 2A, is produced by multiple flutings 22, 24, 26, 28, which form "helicoids" or helixes along the walls of the inner liner. This makes possible a rapid and stationary classification or distribution of the grinding bodies and ore particles. This distribution is a consequence of the helical forward motion that the proposed lining imparts to the grinding bodies and to the ore. This distribution by size has been found to optimize the breaking action of the grinding bodies as a function of the size of the ore. This distribution effect is very important, since it provides large grinding bodies at the feed end of the mill where larger ore particles are encountered and smaller grinding bodies at the discharge end where smaller ore particles are present. This eliminates overgrinding, and also lowers the energy requirements for operation of the mill.

Figure 3:
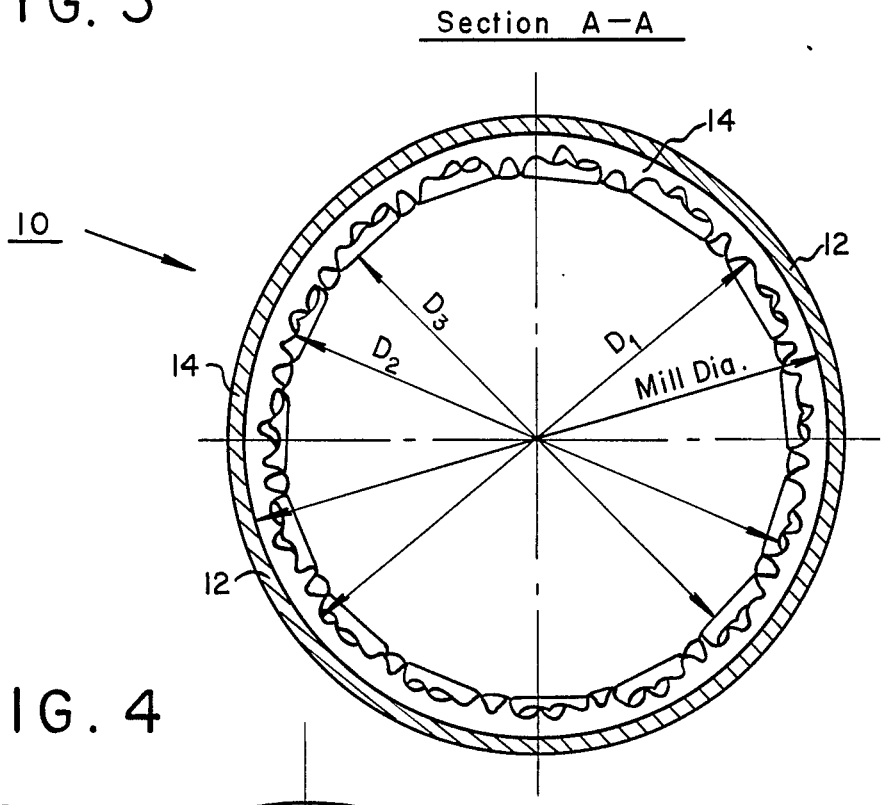
FIGS. 3 and 4 are cross-sectional views taken along lines A—A of FIG. 1, illustrating different configurations of helical fluting and groove depth according to the invention.
Figure 4:
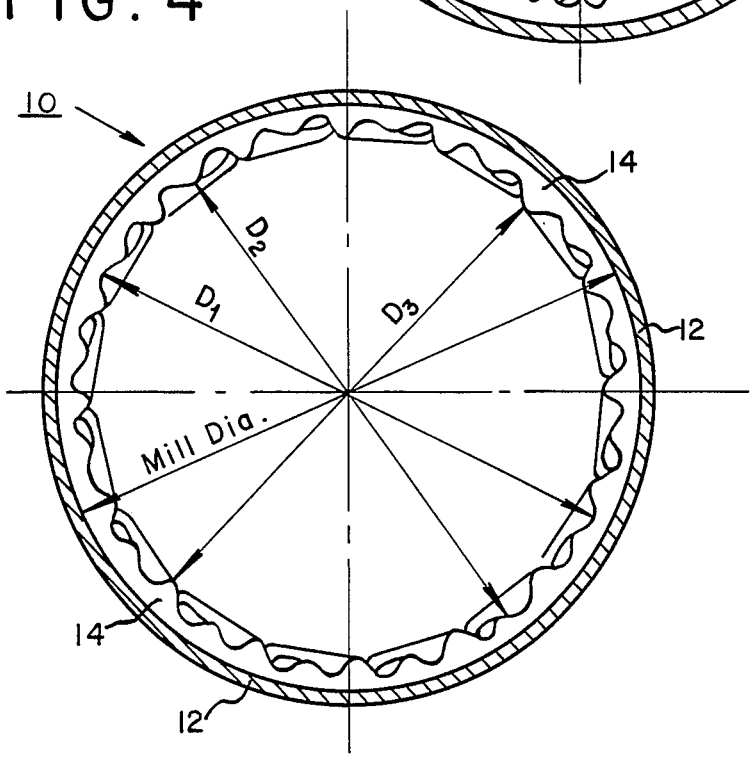
Figure 5:
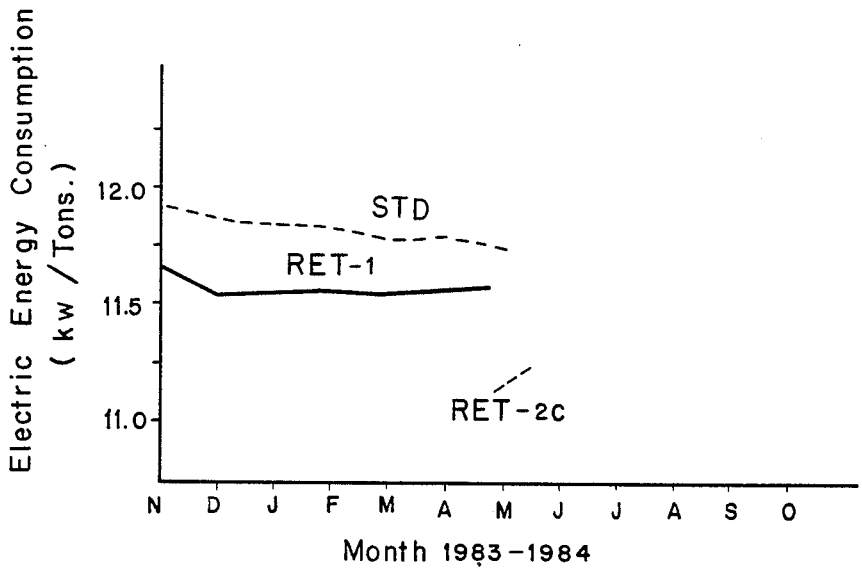
FIG. 5 is a graph of the energy consumption of a grinding mill utilizing the liner of the invention in comparison to those of the prior art.
Figure 6:
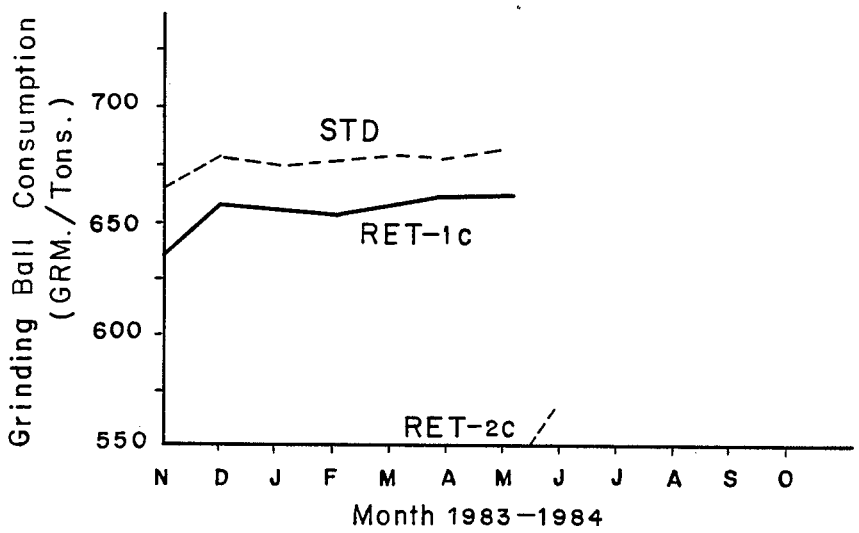
FIG. 6 is a comparative graph of the grinding ball consumption of a mill utilizing the liner of the invention in comparison to that of the prior art.
Figure 7:
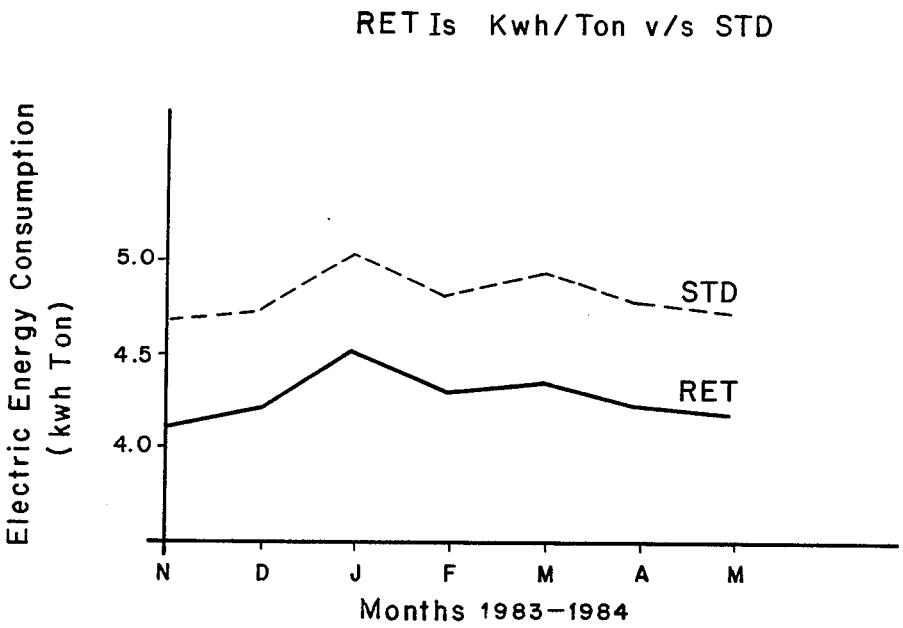
FIG. 7 is a comparative graph of the energy consumption of a grinding mill utilizing a variation of the lining of the invention in relation to a standard lining of the prior art.
Figure 8:
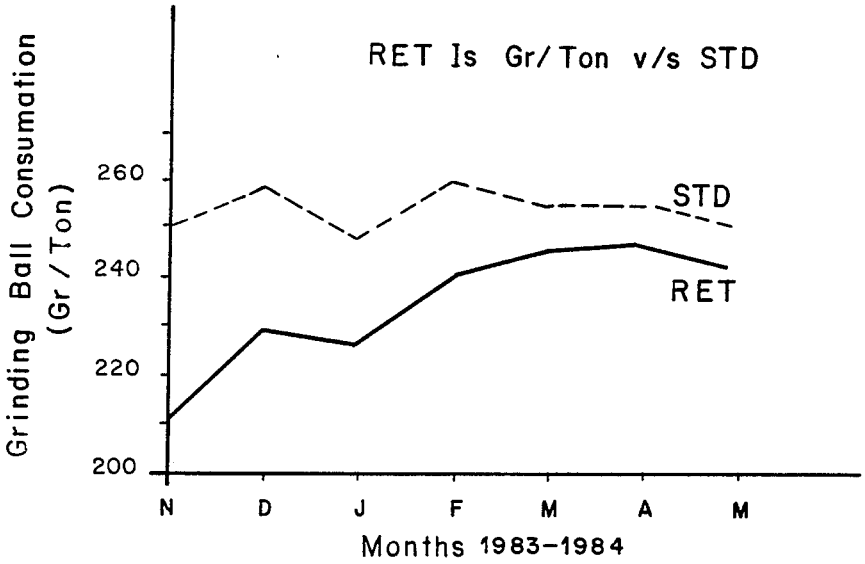
FIG. 8 is a comparative graph of the grinding ball consumption of a mill utilizing a variation of the lining of the invention in relation to a standard lining.

Helical flutings of different geometries and groove depths, as illustrated in FIGS. 3 and 4, produce variations of the inner diameters at each point in the longitudinal direction of the mill, without appreciably reducing the useful volume. This creates a load pulsing effect, which increases the grinding efficiency as described above and leads to an irregular "waterfall" effect along the mill. Each of the grinding bodies reaches the point of separation from the liner at different times and heights, so that the grinding bodies fall in different trajectories onto the load, thus increasing the impact surface and, consequently, the degree of impact by breaking and pressure is greater than conventional prior art grinding mills. This "waterfall" effect, which can also be described as an irregular cascade, combined with the improved distribution of the ore particles and grinding bodies improves the ore grinding operation of the mill.

The liner plates 14 do not require the use of additional supports or bearing elements between them and the outer shell of the mill. This allows faster and easier attachment of the plates to the shell, and results in shorter installation times for this liner than would normally be required for liners of conventional grinding mills.

The position or direction of the helical flutings is a function of the rotational direction and speed of the mill. These features of the liner must be sufficient to induce a helicoidal motion to the grinding bodies and ore load so as to produce the desired distribution of the grinding bodies and ore particles. This distribution favorably affects the grinding of the ore particles by rapidly transporting the fines or smaller ore particles to the mill discharge end. This prevents overgrinding and also increases the grinding efficiency of the mill. The grinding mill efficiency is improved by:

- reducing consumption of grinding bodies,
- reducing the power consumption to run the mill,
- increasing the production volume of ground ore,
- reducing installation down-time compared to linings requiring intermediate supporting structures,
- increasing the service life of the equipment.

To avoid increased costs of operation, the geometry of the flutings on the lining of this invention can be optimized at the pilot plant level in order to avoid premature wear or fracture. The material used in their manufacture must be of at least moderate resistance to impact as well as high resistance to wear in order to provide a useful service life. Such construction materials as ceramics, refractories, ceramic brick, or chilled cast iron have been found to adequately perform this function, although other suitable materials are known to those skilled in the art.

A two year long testing program was performed, both at pilot plants and industrial installations.

The ball classification produced by traditional linings along the longitudinal axis of the mill was first measured with absolutely random results, which are inadequate for efficient grinding.

Then a testing program geared to optimize the grinding media classification by the "screw-ore helicoidal effect" was initiated. Several types of helicoidal grooved multiple plate liners were tested to determine the optimum distribution by a screw or helicoidal effect. The following conditions were varied:

- angle of pitch
- mill rotation direction
- plate groove depths, configurations, quantities and orientation,
- liners inclination angle
- mill shell rotation velocity
- ore charge granulometric distribution
- grinding parameters, The pilot tests were performed with a composite of three ball sizes at different rotation velocities, both clockwise and counter-clockwise for each liner design.

The best results were obtaied with lining RET-1C and are shown in the following table. No significant difference was observed after 10 minutes, 2, 4, 8 or 24 hours of mill operation.

| | Grinding Ball Sizes | | |
|---|---|---|---|
| Sample zones | Largest | Median | Smallest |
| Feed end | 74.8 | 25.2 | 0.0 |
| Center | 15.9 | 83.3 | 0.8 |
| Discharge end | 0.0 | 20.2 | 79.8 |

As a result of the pilot testing this lining was selected for full scale testing in a Hardinge 14 ft×24 ft grinding mill at the Colon Concentrator and in a Marcy 8 ft×12 ft grinding mill at the Sewell Concentrator, El Teniente Division, Codelco-Chile.

The industrial full-scale tests were highly satisfactory showing that the ball charge classification was adequate, speedy, selective and stationary. The ore charge classification was adequate as well. The proposed lining effectively improved the grinding process and the ball and energy consumptions were both reduced compared to traditionally lined mills.

FIGS. 5 to 8, show ball and energy consumption curves obtained from these tests both of the proposed and the traditional standard linings.

A second lining (RET-2C) increasing the ball and energy savings, was designed with the experience gained with the tests on the original development.

The ball and charge classification and the ball and energy savings obtained by the proposed invention are endorsed by technical reports of actual concentrators. Since the tests were performed in different type and size mills with consistent results, the proposed invention can be advantageously applied to any type of circular grinding mill except those using bars or rods as grinding media.

The construction simplicity and the lack of intermediate structural supports, maintain or reduce the liner assembly time compared to conventional liners.

Thus, this testing has confirmed that the design of the helical fluting avoids premature wearing and breakage and provides an equal or better service life compared to conventional linings. Furthermore, the improvement of the distribution of the grinding bodies and ore charge eliminates or substantially reduces "dead zones" or areas where the grinding bodies wear on each other with only minimal ore grinding.

While it is apparent that the invention herein disclosed is well calculated to fulfill the desired results, it will be appreciated that numerous modifications and embodiments may be devised by those skilled in the art, and it is intended that the appended claims cover all such modifications and embodiments as fall within the true spirit and scope of the present invention.

We claim:

1. A cylindrical ball mill comprising:

(a) a cylindrical shell;

(b) means for rotation of said shell; and (c) a liner comprising a continuous uninterrupted, internal helical fluting extending along the length of the liner wherein the helical fluting is non-rectilinear and has a predetermined diametral pitch ratio ranging from about 0.05 to about 0.3 mill turns per length of the mill and wherein the liner gradually and continuously increases in thickness along the length of the mill; said liner being directly supported by said shell.

2. The ball mill of claim 1 wherein the diametral pitch ratio of the liner ranges below about 0.2.

3. A cylindrical grinding mill liner comprising a continuous, uninterrupted, internal helical fluting extending along the length of the liner wherein the helical fluting is non-rectilinear and has a predetermined diametral pitch ratio ranging from about 0.05 to about 0.3 mill turns per length of the mill and wherein the liner gradually and continuously increases in thickness along the length of the mill.

4. The liner of claim 3 wherein said helical fluting comprises a number of helical paths of varying widths.

5. The liner of claim 3 wherein the liner further comprises a predetermined number of plate members each having a longitudinal helical fluting, said plate members being positioned and oriented such that the helical fluting of adjacent plate members forms a number of continuous uninterrupted helical paths along the length of the liner.

6. The liner of claim 5 wherein the plate members have variable thicknesses and are inclined with respect to the longitudinal axis of the liner.

7. The liner of claim 6 wherein the plate members are inclined at an angle of between about 2 and 30 degrees.

8. The liner of claim 3 wherein the diametral pitch ratio ranges below about 0.2.

9. A cylindrical ball mill liner comprising a continuous, uninterrupted, internal helical fluting extending along the length of the liner, said helical fluting being non-rectilinear and having a predetermined diametral pitch ratio of between about 0.05 and about 0.3 mill turns per length of the mill wherein the liner gradually and continuously increases in thickness along the length of the mill and wherein said helical fluting comprises a number of helical paths, each having the same width.

10. The liner of claim 9 wherein the diametral pitch ratio ranges below about 0.2.

11. A cylindrical ball mill liner comprising a continuous, uninterrupted helical fluting extending along the length of the liner comprising a predetermined number of plate members each having a longitudinal non-rectilinear helical fluting having a diametral pitch ratio of between about 0.05 and about 0.3 mill turns per length of the mill; said helical fluting comprising a number of helical paths, each having the same width; said members being of different thicknesses, the plate members increasing the thickness gradually and continuously along the length of the liner and further being inclined with respect to the longitudinal axis of the liner at an angle of between about 2 and 30 degrees; said plate members being positioned and oriented such that the helical fluting of adjacent plate members forms a number of continuous, uninterrupted helical paths along the length of the liner.

12. The liner of claim 11 wherein said helical fluting comprises a number of helical paths of varying widths.

13. The cylindrical ball mill liner of claim 11 wherein the helical fluting creates a load pulsing effect upon an ore charge placed within the mill.

14. The liner of claim 11 wherein the diametral pitch ratio ranges below about 0.2.

15. A cylindrical ball mill comprising:

(a) a cylindrical shell;

(b) means for rotation of said shell; and (c) a liner comprising a continuous, uninterrupted, internal helical fluting extending along the length of the liner, said helical fluting being non-rectilinear and having a predetermined diametral pitch ratio of between about 0.05 and about 0.3 mill turns per length of the mill wherein the liner increases in thickness along the length of the mill and wherein said helical fluting comprises a number of helical paths, each having the same width.

16. The mill of claim 15 wherein the liner further comprises a predetermined number of plate members each having a longitudinal helical fluting, said plate members being positioned and oriented such that the helical fluting of adjacent plate members forms a number of continuous, uninterrupted helical paths along the length of the liner.

17. The mill of claim 16 wherein the plate members are directly assembled on and supported by the shell of the mill.

18. The mill of the claim 16 wherein the plate members are oriented on the shell of the mill so as to be inclined in relation to the longitudinal axis of the mill.

19. The mill of claim 18 wherein the plate members are inclined at an angle of between about 2 and 30 degrees.

20. The ball mill of claim 15 wherein the diametral pitch ratio of the liner ranges below about 0.2.

21. A method for segregating or distributing ore particles and grinding bodies along a cylindrical grinding mill having a first aperture for ore introduction and a second aperture for ore discharge, which comprises:

(a) providing a liner in said ball mill, said liner comprising a continuous, uninterrupted, internal helical fluting extending along the length of the liner wherein the helical fluting is non-rectilinear and has a predetermined diametral pitch ratio ranging from about 0.05 to about 0.3 mill turns per length of the mill and wherein the liner gradually and continuously increases in thickness along the length of the mill;

(b) introducing ore particles and grinding bodies into said bill mill through said introduction aperture and onto said liner; and (c) rotating said mill to segregate or classify said ore particles such that the larger ore particles and grinding bodies remain near the introduction aperture of the mill and the smaller ore particles travel or move toward the discharge aperture of the mill.

22. The method of claim 21 wherein the direction and position of the helical fluting of the liner is determined as a function of the direction of rotation and rotary speed of the mill.

23. The method of claim 21 wherein a predetermined residence time of the ore particles in the mill can be varied by adjusting the geometry of the helical fluting.

24. The method of claim 21 wherein the diametral pitch ratio of the liner ranges below about 0.2.

25. A method for segregating or distributing ore particles and grinding bodies along a cylindrical grinding mill having a first aperture for ore introduction and a second aperture of ore discharge, which comprises:

(a) providing a liner in said ball mill, said liner comprising a continuous, uninterrupted, internal helical fluting extending along the length of the liner, said helical fluting being non-rectilinear and having a predetermined diametral pitch ratio of between about 0.05 and about 0.3 mill turns per length of the mill wherein the liner gradually and continuously increases in thickness along the length of the mill and wherein said helical fluting comprises a number of helical paths, each having the same width;

(b) introducing ore particles and grinding bodies into said ball mill through said introduction aperture and onto said liner of said mill; and (c) rotating said mill to segregate or classify said ore particles such that the larger ore particles and grinding bodies remain near the introduction aperture of the mill and the smaller ore particles travel or move toward the discharge aperture of the mill.

26. The method of claim 25 wherein the liner further comprises a predetermined number of plate members each having a longitudinal helical fluting; said plate members being positioned and oriented such that the helical fluting of adjacent plate members forms a number of continuous uninterrupted spiral paths along the length of the liner.

27. The method of claim 25 wherein the residence time of the ore particles in the mill can be varied by altering the thickness of the plate members.

28. The method of claim 25 wherein the residence time of the ore particles in the mill can be varied by altering the angle of inclination of the plate members.

29. The method of claim 25 wherein the diametral pitch ratio of the liner ranges from about 0.2 to 0.3.

* * * * *